US007815047B2

(12) United States Patent
Trimarco

(10) Patent No.: US 7,815,047 B2
(45) Date of Patent: Oct. 19, 2010

(54) INSULATED BEVERAGE RECEPTACLE

(76) Inventor: Christopher Trimarco, 4110 NE. 27th Ave., Lighthouse Point, FL (US) 33064-8060

( * ) Notice: Subject to any disclaimer, the term of this patent is extended or adjusted under 35 U.S.C. 154(b) by 286 days.

(21) Appl. No.: 11/866,665

(22) Filed: Oct. 3, 2007

(65) Prior Publication Data

US 2009/0090732 A1 Apr. 9, 2009

(51) Int. Cl.
*B65D 75/00* (2006.01)

(52) U.S. Cl. ..... 206/427; 206/139; 206/216; 220/737; 220/739

(58) Field of Classification Search ..... 206/216, 206/217, 457, 831, 139, 427; 220/737, 738, 220/739; 229/103, 208, 87.05, 800
See application file for complete search history.

(56) References Cited

U.S. PATENT DOCUMENTS 1,866,805 A * 7/1932 Haywood ..... 294/31.2
2,015,294 A * 9/1935 Russell ..... 217/56
2,714,448 A * 8/1955 Brown ..... 206/216
3,037,682 A * 6/1962 Daubert ..... 206/217
3,155,234 A * 11/1964 Knoll et al. ..... 206/232
3,314,592 A * 4/1967 Streich ..... 229/74
3,534,898 A * 10/1970 Manizza ..... 229/117
4,293,015 A 10/1981 McGough
4,648,548 A * 3/1987 Shin ..... 229/116.4
5,156,266 A * 10/1992 Sykora ..... 206/216
5,303,863 A 4/1994 Arasim
5,445,315 A * 8/1995 Shelby ..... 229/117.06
5,454,484 A * 10/1995 Chelossi ..... 220/738
5,601,230 A * 2/1997 Bell ..... 229/103
D427,522 S 7/2000 Ponzio
6,164,487 A * 12/2000 Hicks ..... 220/739
6,253,995 B1 * 7/2001 Blok et al. ..... 229/403
6,273,333 B1 * 8/2001 Ward ..... 229/402
2003/0075549 A1 4/2003 O'Brien et al.
2003/0080016 A1 * 5/2003 Lipper ..... 206/459.5
2004/0070222 A1 * 4/2004 Wong ..... 294/31.2
2005/0205651 A1 9/2005 Marx
2006/0243608 A1 * 11/2006 Verbruggen et al. ..... 206/216

* cited by examiner

*Primary Examiner*—David T Fidei
(74) *Attorney, Agent, or Firm*—McHale & Slavin, P.A.

(57) ABSTRACT

A collapsible insulated jacket for a beverage container is formed from the same material as that of the carton in which the beverages are sold. A plurality of insulated jackets are secured together along a perforated line. The plurality of insulated jackets can be formed as a portion of the carton or as a separate item removable secured to the carton. A layer of insulating material can be added to the material of the jacket to provide additional insulating properties for the jacket.

11 Claims, 4 Drawing Sheets

INSULATED BEVERAGE RECEPTACLE

FIELD OF THE INVENTION

The present invention relates to a collapsible jacket or sleeve for a beverage container. The jacket can be formed from paperboard and secured to the paperboard container or case in which the beverages are normally offered for sale.

BACKGROUND OF THE INVENTION

Insulated beverage container holders are well known in the art. The most popular is a sleeve made from foam which snugly surrounds a can. The foam sleeve normally covers 50% or more of the can thus insulating the can and beverage contained therein from the surrounding atmosphere. In the majority of instances the beverage is cold and the surrounding atmosphere is warm. The foam sleeve helps to keep the beverage cold during its consumption. Many companies utilize these insulated beverage holders for advertising purposes and provide them free of charge to their customers. An example of this type of insulated beverage container holder is found in U.S. Pat. No. 4,293,015, issued to McGough. Another advantage of this type of container holder is that condensation from the beverage container is retained by the foam material of the holder and not transferred to the consumer or neighboring surfaces such as furniture.

Recently, insulated beverage container holders for bottles, in particular long neck beer bottles, have become available. These holders are usually equipped with a zipper or other fastener to secure the conforming shape of the holder around the neck of the bottle.

These prior art beverage container holders must be purchased or obtained separately from the purchase of the beverage containers. The consumer of these beverages must remember to bring these prior art container holders with them whenever they are consuming the beverages. They also must remember to bring the container holders home so they can be used again.

What is needed in the art is an insulated beverage container holder or sleeve which does not need to be purchased separately from the beverages. Also, an insulated beverage container holder which is designed to be disposable with the package or carton in which the beverages are sold so that they do not have to be retained by the consumer for reuse.

DESCRIPTION OF THE PRIOR ART

U.S. Pat. No. 5,445,315, issued to Shelby discloses a collapsible beverage container holder which is formed from a single substantially rigid sheet of paperboard. The sheet is substantially rectangular and has two lateral opposite side edges. The sheet is also provided with a plurality of creases. The sheet is folded along the creases and the lateral edges are joined together to form a sleeve into which a beverage container can be placed, as illustrated in FIG. 1. A flap or bottom portion 34 is secured to sheet along the length thereof between two creases, as illustrated in FIG. 2. After the lateral edges are joined together, the free end of the bottom portion is secured to the sheet thereby forming a beverage container holder with a bottom. A layer of insulation material 62 can be bonded to the interior surface of the paperboard. This beverage container holder is designed to be used on an individual basis and not secured to other holders or beverage sales cartons.

A carton of the type in which a plurality of beverage containers are sold that can also be used as a cooler is disclosed in U.S. Pat. No. 5,303,863, issued to Arasim. When the carton is to be used as a cooler the beverage containers are removed from the carton. A plurality of panels which have been detachably secured to the carton are removed therefrom. Another panel formed on the side of the carton is removed thereform along three sides. The forth side remains secured to the carton. The plurality of other panels are attached to the side panel thus forming a bin with the carton, as shown in FIG. 4. The bin is then filled with ice and the beverage containers. The carton then acts as a cooler for the beverage containers. There are no individual insulated beverage container holders disclosed in this patent.

U.S. Published Patent Application No. 2003/0075549, filed by O'Brien discloses an insulated jacket for a beverage can or bottle formed from bubble film. The jacket is made from a blank that is folded along one side and the edges secured together to form a cylindrical jacket for a beverage can or bottle as shown in FIG. 3. While this reference teaches the formation of individual insulated beverage container holders, there is not teaching in the application of a plurality of these jackets secured together or attached to the carton in which the beverages are offered for sale.

Therefore what is lacking in the art is an economical insulated holder for beverage containers which is provided with the carton in which the beverage containers are sold. Also, what is lacking is a plurality of insulated beverage container holders that are secured together such that one or more holders can be utilized. Finally, an economical insulated beverage container holder that requires little storage space and readily unfolds to its operative shape is lacking in the prior art.

SUMMARY OF THE INVENTION

A collapsible insulated jacket for a beverage container is formed from the same material as that of the carton in which the beverages are sold. A plurality of insulated jackets are secured together along a perforated line. The plurality of insulated jackets can be formed as a portion of the carton or as a separate item removable secured to the carton. A layer of insulating material can be added to the material of the jacket to provide additional insulating properties for the jacket.

Accordingly, it is an objective of the instant invention to provide an insulating jacket for a beverage container which is collapsible and formed from a plurality of sheets of paperboard.

It is an additional objective of the instant invention to provide a plurality of insulating jackets for beverage containers which are removable secured to the carton in which the beverage containers are sold.

It is a further objective of the instant invention to provide an insulating jacket for a beverage container wherein a plurality of insulating jackets are removably secured together.

It is yet another objective of the instant invention to provide an insulating jacket for a beverage container formed with an additional layer of an insulating material.

It is a still further objective of the invention to provide an insulating jacket for a beverage container in the shape of a bottle with a long neck.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
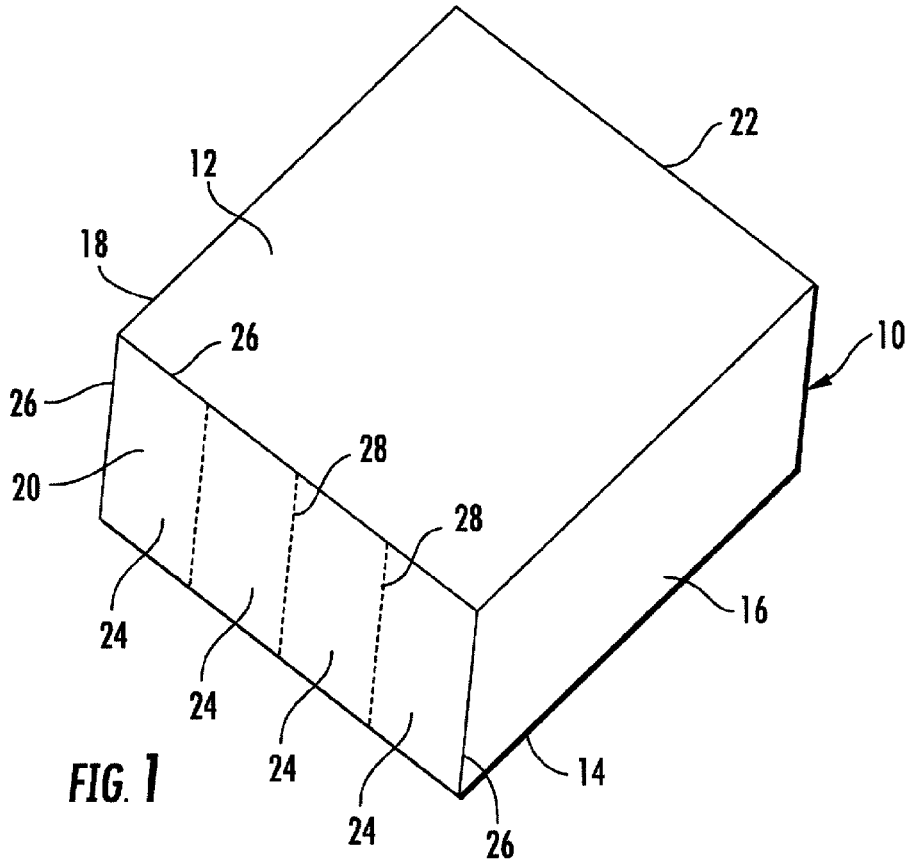
FIG. 1 is an end perspective view of a carton of beverages incorporating the present invention at one end thereof.

Detailed embodiments of the instant invention are disclosed herein, however, it is to be understood that the disclosed embodiments are merely exemplary of the instant invention, which may be embodied in various forms. Therefore, specific functional and structural details disclosed herein are not to be interpreted as limiting, but merely as a basis for the claims and as a representation basis for teaching one skilled in the art to variously employ the present instant invention in virtually and appropriately detailed structure. Like reference numerals refer to like elements in the drawings.

Figure 2:
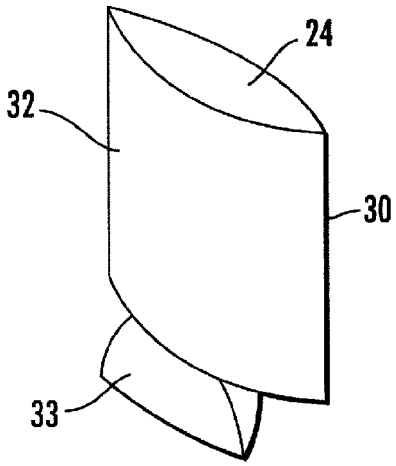
FIG. 2 is a front perspective view of an insulating jacket for a beverage container in its expanded use configuration.
Figure 3:
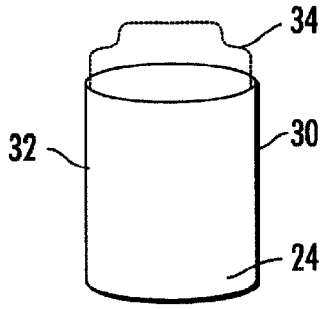
FIG. 3 is a front perspective view of the insulating jacket of FIG. 2 with a beverage can positioned therein.

FIG. 1 illustrates a carton 10 in which a plurality, normally 24, of beverages in cans are sold. Beverages are also sold in cartons which hold 6, 12, 18 and 36 containers of beverages. The number of beverage containers in the carton can vary depending on the manufacturer and seller. The carton 10 includes a top 12, a bottom 14, a plurality of sides 16, 18 and a plurality of ends 20, 22. A plurality of insulated beverage jackets 24 form one end 20 of the carton 10. The jackets 24 are removably secured to the carton with a plurality of perforated connections 26. Other means to removably secure the jackets to the carton can also be employed such as pull tabs, etc. The jackets are also removably secured to each other with a perforated connection 28. The jackets are formed from a plurality of sheets of paperboard which are secured together along two longitudinal edges 30 and 32 as shown in FIGS. 2 & 3. When the jackets are in their stored condition on the carton the sheets of paperboard are flat and touching each other. When the jackets are in their use condition the sheets are expanded away from each other until they form a substantially cylindrical container, a shown in FIGS. 2 and 3. A bottom portion 33 is formed as a portion of one of the sheets of paperboard and attached or secured to the other sheet. The bottom portion is folded, as illustrated in FIG. 2, when the jackets 24 are in their folded conditions. After the jackets are opened and expanded the bottom portion will unfold and cover the bottom of the jacket to help secure the beverage can in the jacket 24.

Jackets 24 can also be formed without bottom portions, as illustrated in FIG. 3. FIG. 3 also illustrates a beverage can 34 surrounded by the insulated jacket 24.

Figure 4:
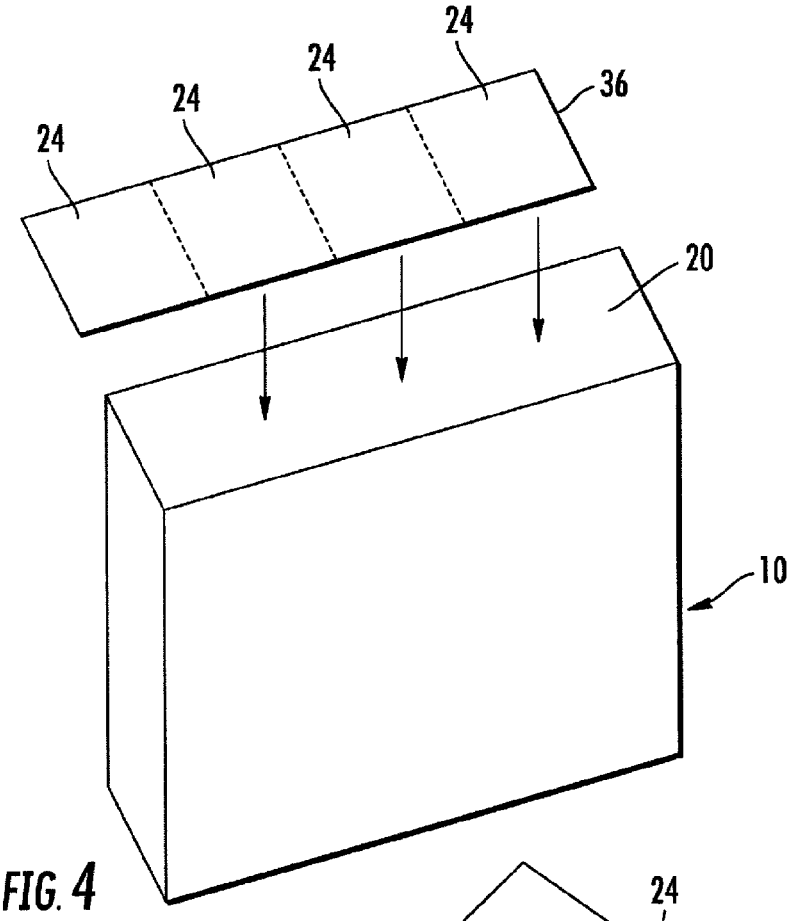
FIG. 4 is a bottom perspective view of a carton of beverages with a separate strip of insulating jackets illustrating the manner in which they can be secured to one end of the container.

Another embodiment of the present invention is illustrated in FIG. 4. A plurality of insulating jackets 24 are formed into a strip 36. The strip 36 is removable secured to an end 20 of a carton 10 of beverages. The strip 36 does not form a portion of the carton. The strip can be secured be to the carton by perforated connections, adhesive, tear strips, etc. After the strip 36 is removed from the carton, the individual insulating jackets 24 are detached from each other and expanded into their operative condition as illustrated in FIGS. 2 and 3.

Figure 5:
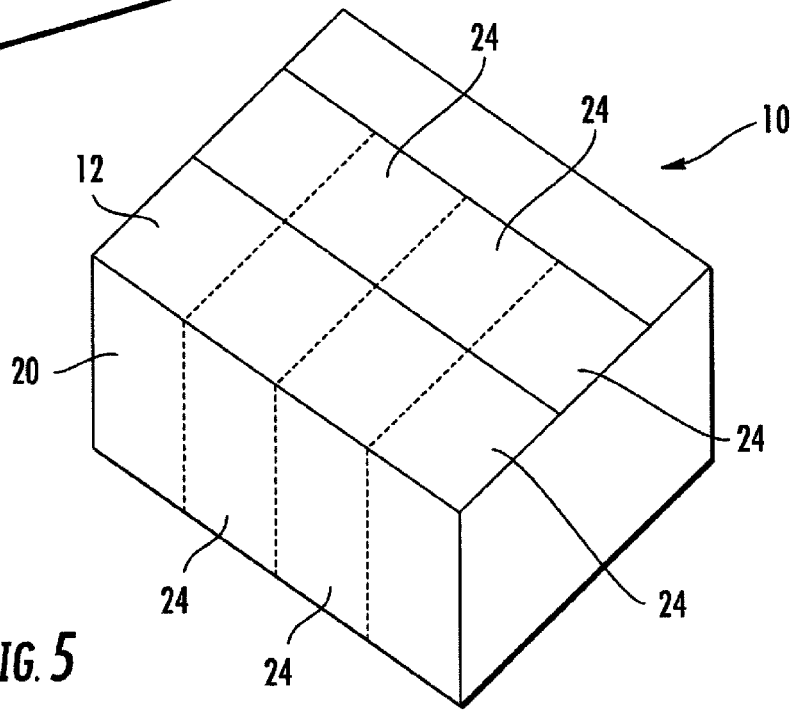
FIG. 5 is an end perspective view of a carton of beverages illustrating a plurality of insulating jackets integrally formed into the sides of the carton.

Another embodiment of the present invention is illustrated in FIG. 5. In this embodiment the insulating jackets 24 form both an end 20 and the top 12 of the beverage carton 10. Any portion of the beverage carton could be formed from the insulating jackets 24. The jackets 24 are secured to the carton 10 in the same manner as the jackets 24 in FIG. 1.

Figure 6:
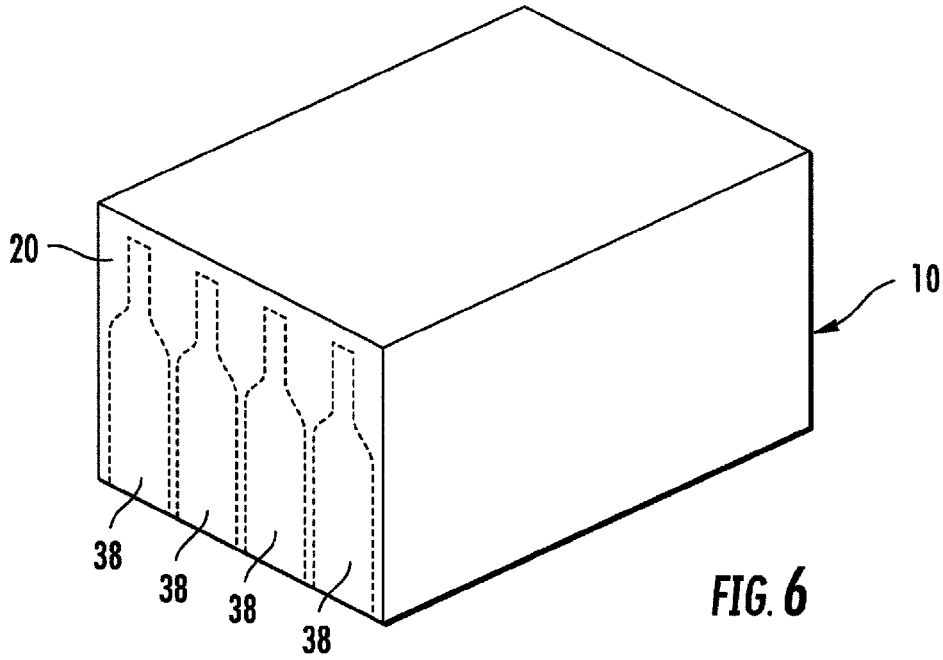
FIG. 6 is an end perspective view of a carton of beverages illustrating a plurality of insulating jackets designed for bottles.
Figure 9:
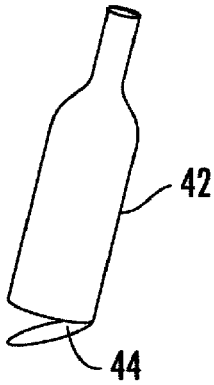
FIG. 9 is a perspective view of the insulating container jacket for a bottle that is also provided with a bottom panel and FIG. 10 is a perspective view of a bottle placed into an insulating jacket designed for a can.

Another embodiment of the invention is illustrated in FIG. 6. This embodiment is similar to the embodiment of FIG. 1 except that the insulating jackets 38 are designed to surround a bottle with a long neck. Each of the insulating jackets is in the shape of a bottle and removably secured to an end 20 of the carton 10. The upper end of the jackets is open and the lower end is provided with a bottom portion 44, as illustrated in FIG. 9. The bottom portion 44 is hingedly attached at one end to the jacket 42 and has another end which is secured between the jacket 42 and the bottle.

Figure 8:
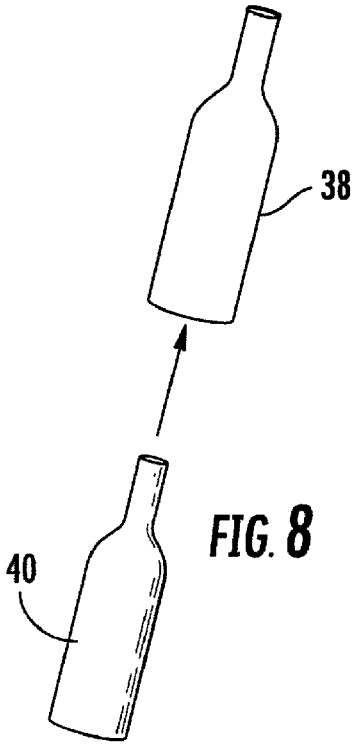
FIG. 8 is a perspective view illustrating the manner in which a bottle is inserted into the insulating container jacket.

A plurality of jackets 38 can be secured together and removably secured to a carton similar to the strip 36 of FIG. 4. After the jacket 38 is removed from the carton, it is expanded such that a bottle 40 can be placed therein from the lower end, as shown in FIG. 8. The top of the bottle extends through the top of jacket 38 so that the beverage can be consumed from the bottle.

Figure 7:
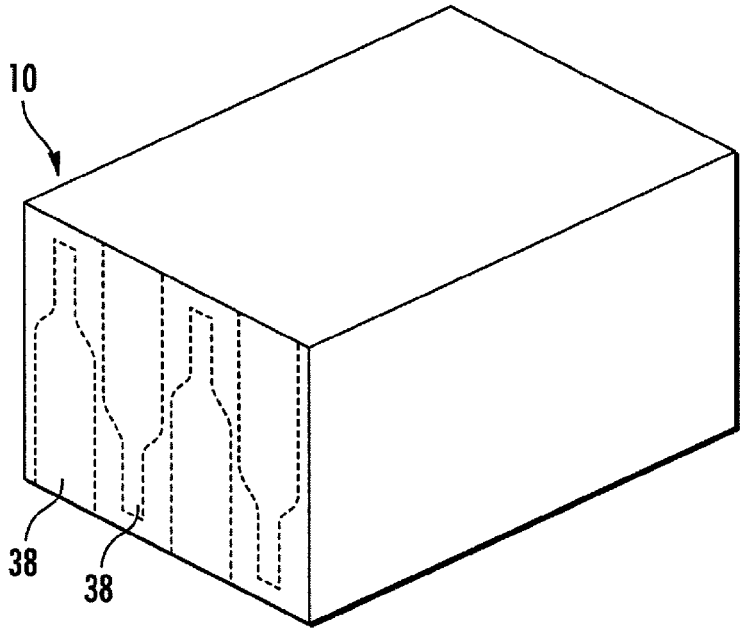
FIG. 7 is an end perspective view of a carton of beverages illustrating a plurality of insulating jackets designed for bottles arranged in alternating right side up and up side down configurations.

The jackets 38 can be arranged in an alternating right side up and up side down arrangement on the carton 10 so as to conserve space, as illustrated in FIG. 7.

In another embodiment, illustrated in FIG. 8, the jacket 38 is provided without a bottom panel to help secure bottle 40 into the jacket 42.

Figure 10:
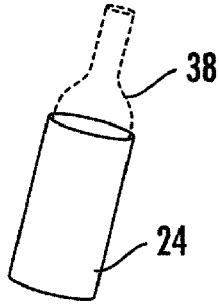

The insulating jacket 24 of FIGS. 1-5 can also be placed around a bottle 38 as illustrated in FIG. 10. The jacket 24 will insulate the majority of bottle 38.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A collapsible insulating jacket for a beverage container comprising:

a sleeve surrounding a substantial portion of an outer surface of the beverage container;

said sleeve formed from a plurality of separate and distinct sheets of material;

said sleeve having an upper end, a lower end and a plurality of lateral side edges, said side edges being secured together to form said sleeve;

said upper end and said lower end of said sleeve being open and permitting insertion of the beverage container within said sleeve; and said sleeve being detachably secured to a carton in which a plurality of said beverage containers are retained.

2. The collapsible insulating jacket of claim 1 wherein a plurality of said insulating jackets are detachably secured together.

3. The collapsible insulating jacket of claim 1 wherein said sheets of material are paperboard.

4. The collapsible insulating jacket of claim 1 wherein said sheets of material further include a layer of insulating material.

5. The collapsible insulating jacket of claim 2 wherein said plurality of insulating jackets form one side of said carton.

6. The collapsible insulating jacket of claim 2 wherein said plurality of insulating jackets are secured to said carton in a manner that allows an individual said insulating jacket to be removed while said other insulating jackets remain secured to said carton.

7. The collapsible insulating jacket of claim 1 further including a bottom portion extending across said lower ends of said sleeve when said sleeve is expanded to surround said beverage container.

8. The collapsible insulating jacket of claim 1 wherein said insulating jacket further includes a neck portion which is substantially narrower in width than said sleeve.

9. The collapsible insulating jacket of claim 8 wherein a plurality of said insulating jackets are secured together.

10. The collapsible insulating jacket of claim 9 wherein said plurality of insulating jackets are arranged with said neck portion being alternatively in upright and upside down positions.

11. The collapsible insulating jacket of claim 2 wherein said plurality of insulating jackets form a separate panel which is removably secured to said carton.

* * * * *